United States Patent [19]

White

[11] Patent Number: 4,977,332

[45] Date of Patent: Dec. 11, 1990

[54] POWER SWITCHING APPARATUS

[75] Inventor: R. C. White, San Diego, Calif.

[73] Assignee: Sundstrand Corporation, Rockford, Ill.

[21] Appl. No.: 347,532

[22] Filed: May 4, 1989

[51] Int. Cl.[5] ..... H01H 47/00

[52] U.S. Cl. ..... 307/113; 307/115; 307/242; 307/480

[58] Field of Search ..... 307/112, 113, 115, 126, 307/129, 141, 241, 242, 480

[56] References Cited

U.S. PATENT DOCUMENTS

| | | | |
|---|---|---|---|
| 3,800,299 | 3/1974 | Panther | 307/241 X |
| 4,327,693 | 5/1982 | Busser | 301/154 |
| 4,479,161 | 10/1984 | Henrich et al. | 361/154 |
| 4,720,762 | 1/1988 | Estes | 361/154 |
| 4,764,840 | 8/1988 | Petrie et al. | 361/154 |
| 4,818,988 | 4/1989 | Cooperman et al. | 307/241 X |

*Primary Examiner*—Derek S. Jennings
*Attorney, Agent, or Firm*—William D. Lanyi

[57] ABSTRACT

A power switching apparatus is provided with a plurality of power switching elements in which each power switching element is configured to receive an input signal, a carry-in signal and two partial duty cycle signals. The power switching element is also configured to provide an output signal and a carry-out signal. A power switching apparatus made in accordance with the present invention comprises a plurality of such power switching elements associated together with each power switching element having it carry-in signal being provided by the carry-out signal of another preceding power switching element and, additionally, having it carry-out signal being associated with the carry-in signal of a subsequent associated power switching element. The combination of power switching elements provides a power switching apparatus with a plurality of inputs and a plurality of outputs wherein the plurality of outputs are generally equally distributed between two alternative wave forms. Each of the signal processing elements of the present invention can be configured to provide a continuous output signal following the initiation of an input signal wherein the continuous output signal is maintained for a predetermined period of time after which the output signal takes the form of a partial duty cycle signal.

19 Claims, 7 Drawing Sheets

POWER SWITCHING APPARATUS

FIELD OF THE INVENTION

The present invention relates generally to a power switching apparatus and, more particularly, to an apparatus which comprises a plurality of power switching elements with each of the power switching elements providing an output signal in response to receipt of an input signal. The output signal is a logically selected one of two partial duty cycle signals and, when the power switching element is combined with other similarly configured power switching elements, the plurality of output signals are distributed in an alternating manner so that the two types of output signals are generally equally utilized. This significantly reduces the electrical noise reflected onto the power source that is being switched. The present invention also comprises a means for providing a continuous signal for a predetermined period of time prior to the onset of the partial duty cycle operation.

DESCRIPTION OF THE RELATED ART

Many types of electronic circuits are known to those skilled in the art for the purpose of providing solenoid drivers or relay drivers. U.S. Pat. No. 4,327,693, which issued to Busser on May 4, 1982, describes a solenoid driver which uses a single boost circuit. A driver circuit is provided for electronically actuating, in a predetermined sequence, a plurality of solenoids. The driver includes a single boost circuit having an inductor for receiving energy from a power supply and a capacitor for storing a portion of this electrical energy prior to activation of a particular solenoid. It further includes electronic circuitry associated with each solenoid for energizing the solenoid by causing the capacitor to discharge through the solenoid and to regenerate the stored voltage potential prior to the time for energizing another solenoid. The drive circuit for the solenoid driver further includes a means for controlling the magnitude of the current flowing through each solenoid.

U.S. Pat. No. 4,479,161, which issued to Henrich et al on Oct. 23, 1984, describes a switching type driver circuit for a fuel injector. The switching type control unit is intended for use in activating fuel injectors of an internal combustion engine. The control unit includes a plurality of switching circuits for turning associated hybrid power circuits on and off. The hybrid power circuits communicate the increased level of voltage generated by a single boost voltage generator to particular injectors.

U.S. Pat. No. 4,764,840, which issued to Petrie et al on Aug. 16, 1988, describes a dual limit solenoid driver control circuit. The control circuit senses solenoid current and provides two separate comparators with the magnitude of the solenoid current. Each comparator receives fixed maximum and minimum reference threshold levels which determine the maximum and minimum current limits for solenoid current during initial pull-in excitation. Subsequently, during a hold period following pull-in period, each of the comparators receives different maximum and minimum thresholds so as to establish holding solenoid current limits. The outputs of the comparators are connected as inputs to a flip-flop whose output controls the operation of a solenoid driver circuit. A monostable multivibrator reacts to an initial control pulse to produce a predetermined pull-in time pulse that results in the maximum and minimum pull-in solenoid current limits. The comparator thresholds are provided by a fixed resistor divider circuit which receives a pull-in signal from the monostable multivibrator. The pull-in is independent of the sensed solenoid current and the switching thresholds are fixed and independent of the magnitude of the solenoid current during the pull-in and hold. The above is readily implemented with few components.

U.S. Pat. No. 4,720,762, which issued to Estes on Jan. 19, 1988, describes a current drive circuit. The circuit is an arrangement for controlling the current in a solenoid. A microcomputer is used to control three states of a three-state output device which are designed to correspond to three current modes of the solenoid; no current, full current, and reduced current. The three-state output device produces a signal which is used to control a solenoid drive circuit. The drive circuit includes first means for generating a first drive signal in response to the three-state signal being in the high impedance state or the low state and second means for generating a second drive signal in response to the three-state signal being in the high impedance state or the high state. The circuit further includes third means for coupling the first and second drive signals to the solenoid such that the current in the solenoid is controlled according to the states of the three-state signal.

Although the prior art describes many different types of electronic circuits with solenoid or relay driving capacity, no known circuit provides a means by which a plurality of input signals can be received in any combination of high and low logic states with the corresponding outputs being assigned alternating partial duty cycle wave forms in a manner which generally equally distributes the two partial duty cycle wave forms among the outputs. This alternating of the output partial duty cycle signal minimizes the switching perturbations that can be reflected back to the power supply associated with the driver circuit.

SUMMARY OF THE INVENTION

The present invention provides a multi-channel relay or solenoid driver circuit which is capable of assigning two distinct partial duty cycle signals as outputs corresponding to inputs of the circuit, wherein the two partial duty cycle signals are generally equally distributed among the outputs in an alternating manner. The present invention provides a power switching apparatus which comprises one or more power switching elements which are intended to be used in combination with other similarly configured power switching elements. Each individual power switching element comprises a means for receiving a first input signal which represents an intended activation state of a solenoid or relay. The power switching element additionally comprises a means for providing a logically selected one of a plurality of output signals in response to the input signal achieving a logically high state. A preferred embodiment of the present invention logically selects one of two output wave forms as an output signal, wherein the two selectable wave forms are each partial duty cycle signals. When two or more power switching elements are associated together, each power switching element comprises a means for receiving a carry-in signal and a means for providing a carry-out signal. The carry-in signal represents the type of output wave form provided by the preceding activated power switching element and the carry-out signal represents the type of output wave form provided by the activated power switching element from which the carry-out signal emanates. When a plurality of power switching elements are associated together, each element communicates with other elements through the use of its carry-in signal and carry-out signal so that a combination of power switching elements will assure that the outputs are distributed generally equally by the plurality of power switching elements.

A preferred embodiment of the present invention comprises a plurality of power switching elements in which each power switching element comprises a means for providing a first output signal, a means for receiving a first input signal, a means for receiving a first carry-in signal, a means for providing a carry out signal, a means for receiving a first partial duty cycle signal, a means for receiving a second partial duty cycle signal and a means for connecting a logically selected one of a first and second partial duty cycle signals in signal communication with the output of the power switching element in response to the logical states of the carry-in signal and the input signal. The carry out signal of the power switching element is representative of the combined logical states of the carry-in signal and the input signal.

BRIEF DESCRIPTION OF THE DRAWING

The present invention will be more fully and completely understood from a reading of the description of the preferred embodiment in conjunction with the drawing, in which.

DESCRIPTION OF THE PREFERRED EMBODIMENT

Figure 1:
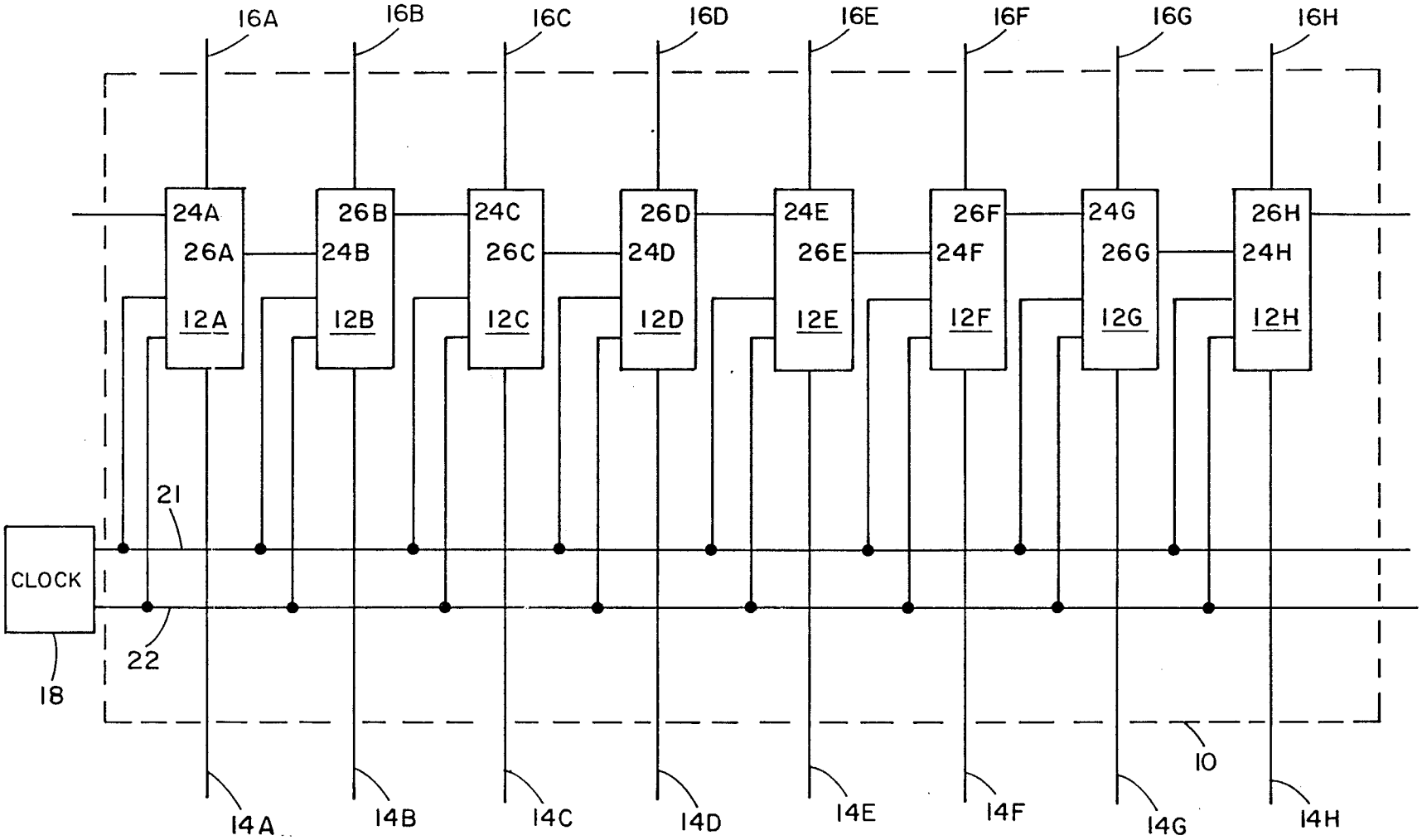
FIG. 1 illustrates a simplified schematic of the present invention.

A power switching apparatus made in accordance with the present invention is illustrated in FIG. 1. The power switching apparatus 10 is represented by a dashed line which encloses a plurality of power switching elements 12A–12H. Each power switching element is provided with a means for receiving an input signal and a means for providing an output signal. For example, power switching element 12A is provided with an input signal receiving means 14A and an output signal providing means 16A. These input signal receiving means 14A–14H and output signal providing means 16A–16H are associated with their corresponding power switching elements 12A–12H as shown in FIG. 1. In addition, a clock 18 is used to provide two partial duty cycle signals on lines 21 and 22. Each of the power switching elements 12A–12H is provided with means for receiving each of the two partial duty cycle signals from lines 21 and 22, as shown in the schematic of FIG. 1.

Each power switching element 12A–12H is provided with a means for receiving a carry-in signal. These carry-in signal receiving means are identified by reference numerals 24A–24H. In addition, each power switching element 12A–12H is provided with a means for providing a carry-out signal. These carry-out signal providing means are identified by reference numerals 26A–26H. As can be seen in FIG. 1, the carry-out signal providing means of each power switching element is connected in signal communication with the carry-in receiving means of the subsequent power switching element. This interconnection between the power switching elements permits each element to recognize the type of output signal that is provided by the preceding element with which a logically high input signal is present on its input signal receiving means.

With continued reference to FIG. 1, it should be understood that each of the output signals providing means 16A–16H is intended to be connected to either a solenoid or a relay which is to be driven in response to the receipt of a logically high signal on the corresponding signal receiving mean 14A–14H. The present invention provides a power switching apparatus 10 which assures that each logically high input 14A–14H is associated with an output signal 16A–16H which is selected, from the two lines 21 and 22, to be different than the output signal associated with the adjacent power switching elements which also have logically high input signals. This further assures that each activated power switching element provides an output signal which is different in form from the output signals emanating from adjacent activated power switching elements.

Figure 2:
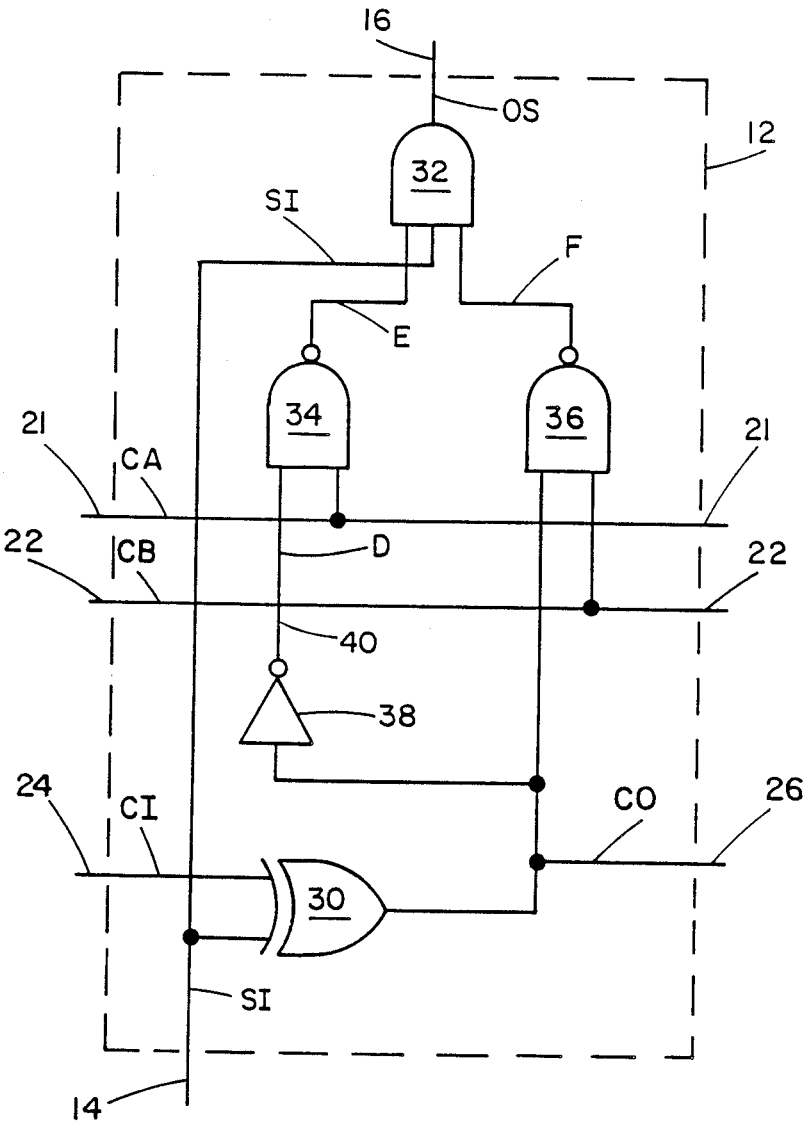
FIG. 2 illustrates a detailed logical schematic of one power switching element of the present invention.

FIG. 2 illustrates one power switching element 12 which is configured in accordance with the present invention to be associated with other similarly configured power switching elements as illustrated in the power switching apparatus 10 of FIG. 1. In FIG. 2, it can be seen that the power switching element 12 is provided with a means for receiving an input signal 14 and a means for providing an output signal 16. In addition, the power switching element 12 is provided with a means for receiving a carry-in signal 24 and a means for providing a carry-out signal 26. Also, the power switching element 12 is provided with a means for receiving two partial duty cycle signals on line 21 and 22. For purposes of this description, these signal lines and signals have been labeled by the reference letters and reference numerals illustrated in FIG. 2. For example, the input signal SI is received on line 14 and the output signal OS is provided on line 16. In addition, the clock signals, CA and CB, are received on lines 21 and 22, respectively, and represent the two selectable partial duty cycle signals. The carry-in signal CI is received on line 24 and the carry-out signal CO is provided on line 26.

As can be seen in the detailed logical schematic of FIG. 2, the input signal SI and the carry-in signal CI are connected, as inputs, to an exclusive-OR device 30. The input signal SI is also connected as one of the three inputs to the AND device 32. The output of the exclusive-OR device 30 is connected to line 26 to provide the carry-out signal CO and, in addition, is connected in signal communication with the two NAND devices, 34 and 36. The output from the exclusive-OR device 30 is connected directly as an input to NAND device 36 which has, as its other input, the partial duty cycle signal CB from line 22. The other NAND device 34 is provided with one input connected to the partial duty cycle CA from line 21 and another input connected to the inverted form of the carry-out signal CO from line 26. The carry-out signal CO passes through an inverter 38 which is connected serially between the output of the exclusive-OR device 30 and the input of the NAND device 34, shown in FIG. 2. The outputs from the two NAND devices, 34 and 36, are connected as shown to two of the three inputs of the AND device 32.

When a logically high input signal SI is received on line 14, the carry-out signal CO on line 26 is assigned a logic state that is opposite to the logic state of the carry-in signal CI on line 24. As long as the input signal SI is logically low, the carry-in signal CI and the carry-out signal CO have identical logical states. When a logically high input signal SI is received, the carry-in signal CI and the carry-out signal CO are assigned opposite logical states. This permits the power switching element 12 to provide information to subsequent power switching elements relating to the specific output wave from provided as an output signal OS on line 16. This additionally permits subsequent power switching elements to provide output signals which are alternating in form when a plurality of power switching elements are associated together as illustrated in FIG. 1. For purposes of this description, hypothetical logical states will be assigned to the input signal SI and the carry-in signal CI to permit the relationship of the other signals to be described in greater detail. Assuming that the carry-in signal CI is logically high, the carry-out signal CO will be assigned a logically low state upon receipt of a logically high input signal SI. As a result, the input of NAND device 36 which is connected to the carry-out signal CO will be in a logically low state. This will cause the output of NAND device 36 to be logically high at all times. In addition, the input of the AND device 32 which is connected to the input signal SI will also be logically high as long as the input signal SI and the carry-in signal CI remains logically high Since the carry-out signal CO is logically low in this example, the output of the inverter 38, on line 40, will be logically high as long as the carry-out signal CO remains logically low. Therefore, the NAND device 34 will have one input which is always logically high and, therefore, the output from the NAND device 34 will be determined by the logical state of the partial duty cycle signal CA on line 21. More specifically, the output signal E from the NAND device 34 will vary inversely with the logical state of partial duty cycle CA. Since two of the three inputs of the AND device 32 are logically high, the output signal OS will vary directly with the logical state of signal E which is the output from the NAND device 34.

Continuing with this hypothetical example, if the input signal SI on line 14 returns to a logically low state, the AND device 32 will be deprived of one of its three inputs and the output signal OS will go to a permanently low state. If, however, the input signal SI remains logically high, but the carry-in signal CI changes from a logically high to a logically low state, the output signal OS will change from being functionally dependent on signal CA to being functionally dependent on signal CB. For example, with the carry-in signal CI being low and the input signal SI being high, the carry-out signal CO will be logically high. This will provide a logically low signal as the output of the inverter 38 and will, in turn, provide a continuous logically high output signal form the NAND device 34. The NAND device 36 will be provided with a continually high input from line 26 and, therefore, the output of the NAND device 36 will depend functionally on the partial duty cycle CB on line 22. More specifically, the output signal F from NAND device 36 will be an inverted form of the partial duty cycle signal CB as long as the input signal SI remains logically high and the carry-in signal CI remains logically low.

In summary, it can be seen from the above description that no output signal OS is provided as long as the input signal SI remains logically low. In addition, it can be seen that a logically high state of the input signal SI will be accompanied by an output signal OS that is functionally related to an inverted form of partial duty cycle CA as long as the carry-in signal CI is logically high. Furthermore, the output signal OS will be functionally related to an inverted form of the partial duty cycle signal CB as long as the carry-in signal CI is logically low.

Figure 3:
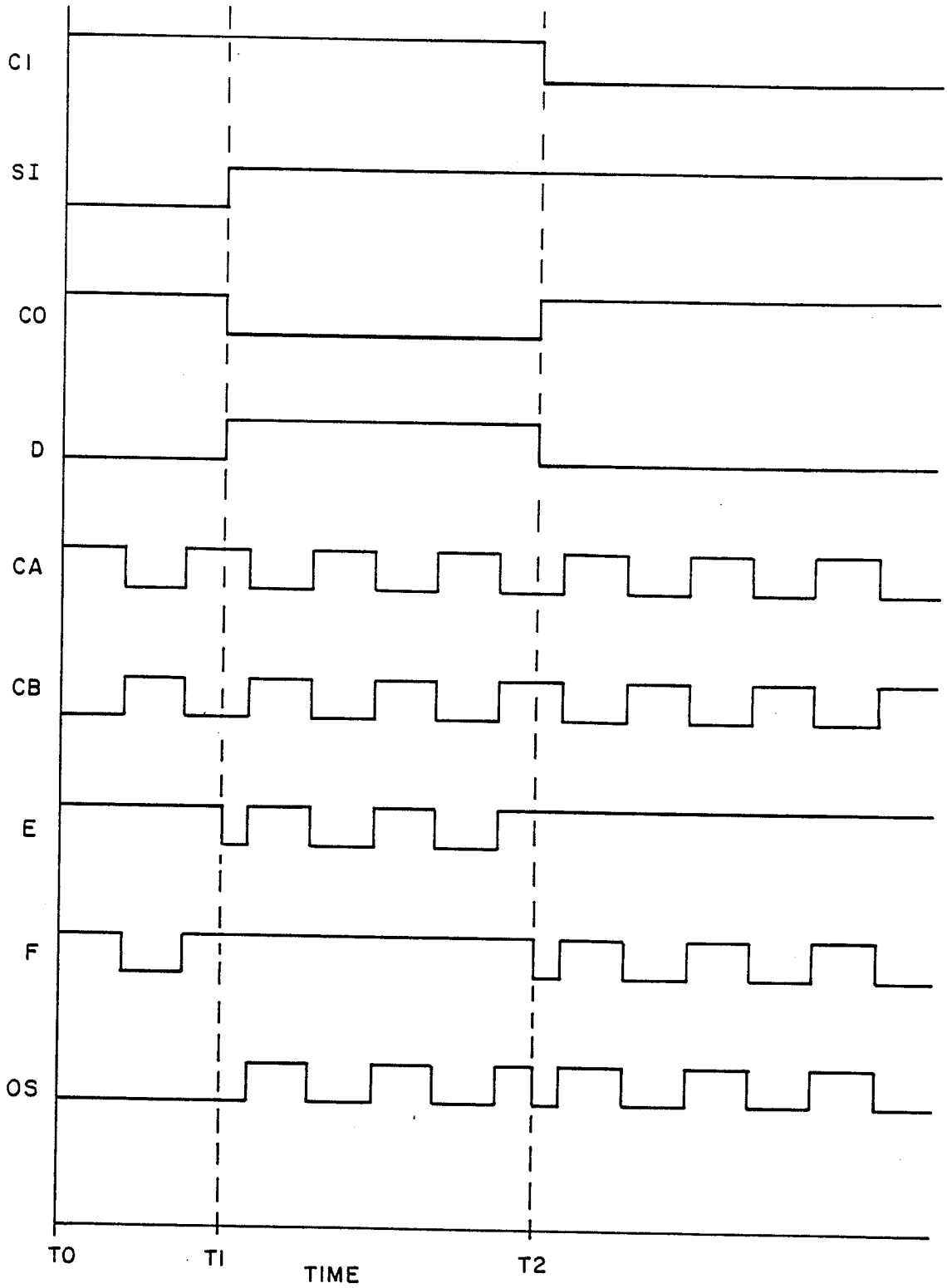
FIG. 3 is a timing diagram illustrating the relevant signals relating to a power switching element of the present invention.

The relationship described above is illustrated, as a timing diagram, in FIG. 3. In FIG. 3, three specific event times, T0, T1 and T2, are illustrated. Beginning at time T0, the carry-in signal CI is logically high and the input signal SI is logically low. This results in a carry-out signal CO which is logically high and a signal D, which is the output of the inverter 38 in FIG. 2, that is logically low. For purposes of this example, the first partial duty cycle signal CA and the second partial duty cycle signal CB are illustrated as square waves with a 50% duty cycle. In addition, these two partial duty cycles are assigned wave forms which are inverted versions of each other. Signal E is the output from NAND device 34 and signal F is the output from NAND device 36. As can also be seen in FIG. 3, the output E from NAND device 34 is constantly high at time T0 because of the fact that signal B is low at this time. Signal F, which is the output from NAND device 36, varies inversely with partial duty cycle signal CB. Because of the fact that the input signal SI is logically low, the output signal OS is logically low during the period from time T0 to time T1.

At time T1, the input signal SI is shown as changing from a logically low state to a logically high state. Because of the fact that the carry-in signal CI is logically high at time T1, this change in state of the input signal SI causes the carry-out signal CO to change from a logically high to a logically low state. Because of the operation of the inverter 38, signal D changes from a logically low to a logically high state at time T1 in response to the change in the carry-out signal CO. The output signal E from the NAND device 34 begins to vary inversely with the logical state of the partial duty cycle signal CA. In addition, the output signal F from the NAND device 36 maintains a logically high state because of the continued logically low state of the carry-out signal CO. As a result, the AND device 32 is provided with two logically high input signals, SI and F, and therefore varies directly with the logical state of signal E. This is illustrated between time T1 and time T2 by the partial duty cycle form of the output signal OS which varies inversely with the partial duty cycle signal CA.

At time T2 in FIG. 3, the carry-in signal CI changes from a logically high to a logically low state. This change would typically be caused by the change in the state of an input signal of a power switching element upstream from the power switching element 12 in FIG. 2. As shown in FIG. 3, this change in state of carry-in signal CI occurs while the input signal SI remains logically high. This change immediately causes the carry-out signal CO to change state from logically low to logically high. Through the natural operation of the inverter 38, signal D immediately changes state in the opposite direction. Because of the logically low state of signal D, the output E from NAND device 34 remains logically high following the occurence at time T2. Because of the logically high state of the carry-out signal CO, the output F from NAND device 36 will begin to vary inversely with the partial duty cycle signal CB on line 22. Following time T2, the AND device 32 is provided with two logically high signals, SI and E, and will therefore vary directly with signal F. The result of this is shown by the change in the output signal OS, at time T2, from an inverse relationship with partial duty cycle signal CA to an inverse relationship with partial duty cycle signal CB. It is important to understand that the change in the output signal OS at time T2, did not alter the fact that the output signal OS is a partial duty cycle signal that is provided to its associated solenoid or relay. However, the partial duty cycle signal provided as an output signal OS changes in its functional dependency from being inversely dependent on partial duty cycle signal CA to being inversely dependent on partial duty cycle signal CB.

Figure 4:
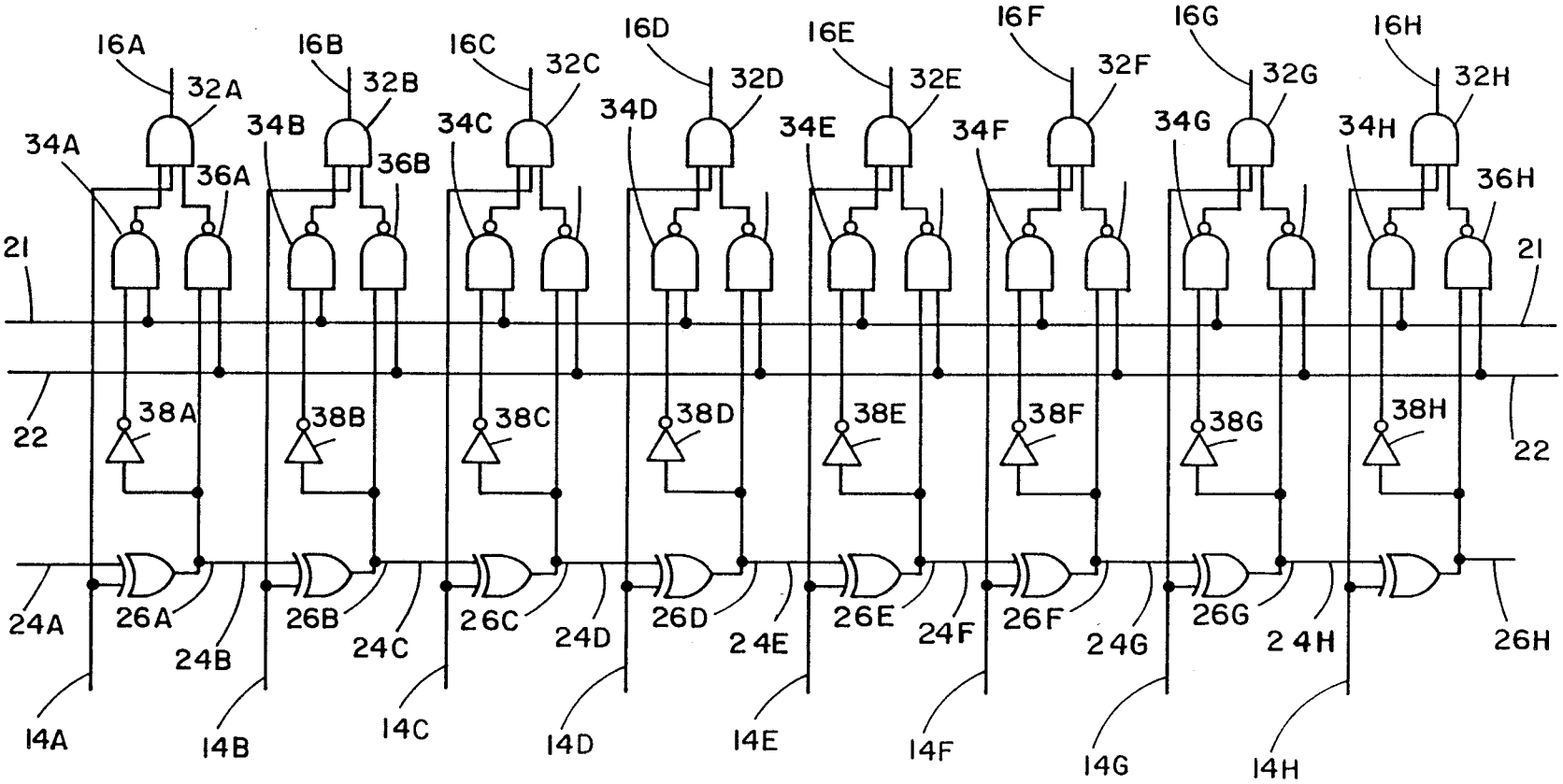
FIG. 4 is a detailed logical schematic of a power switching apparatus made in accordance with the present invention and comprising a plurality of power switching elements.
Figure 5:
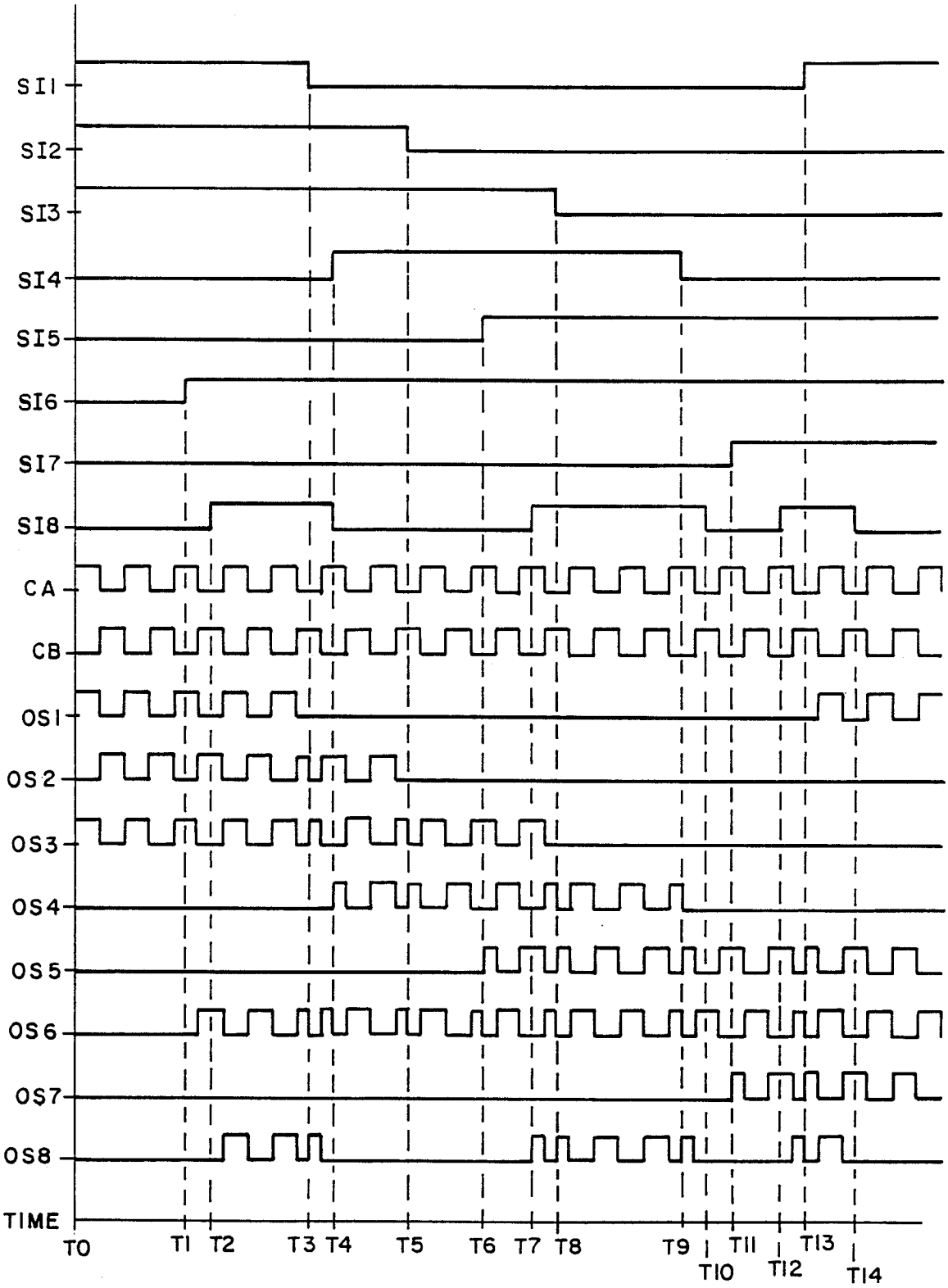
FIG. 5 is a timing diagram of signals relating to the apparatus shown in FIG. 4.

FIG. 4 illustrates the power switching apparatus made in accordance with a preferred embodiment of the present invention which comprises a plurality of power switching elements. FIG. 4 is functionally similar to the schematic illustration of FIG. 1, but with the specific internal components of each power switching element shown in greater detail. The power switching apparatus shown in FIG. 4 provides a multichannel, two-level driver circuit which is capable of providing output signals to eight devices, such as relays or solenoids, in response to eight corresponding input signals. The operation of each power switching element within the multichannel power switching apparatus of FIG. 4 is similar to that described above in conjunction with FIGS. 2 and 3. FIG. 5 illustrates a timing diagram which relates to the apparatus of FIG. 4 and which illustrates a hypothetical chronology of events provided for the purpose of describing the interrelationship between the individual power switching elements in the apparatus of FIG. 4. In the timing diagram of FIG. 5, each input signal is illustrated in the top portion of the figure and each output signal is illustrated in the bottom portion of the figure, with the two partial duty cycle signals, CA and CB, illustrated in the center of the timing diagram. In the terminology of FIG. 5, the input signal for the first power switching element, on line 14A, is designated SI1, the input signal for the second power switching element, on line 14D, is designated SI2, and so on, with the input signal for the eighth power switching element, on line 14H, being designated SI8. Similarly, the output signal for the first power switching element in FIG. 4, on line 16A, is designated OS1, the output signal for the second power switching element, on line 16B, is designated OS2, and so on, with the output signal for the eighth power switching element in FIG. 4, on line 16H, being designated OS8.

Beginning at time T0, it can be seen from FIG. 5 that, from time T0 to time T1, input signals SI1, SI2 and SI3 are logically high and the remaining input signals, SI4–SI8, are logically low. This results in output signals OS1, OS2 and OS3, being in the form of partial duty cycle signals, as shown in FIG. 5, with the other output signals, OS4–OS8, being at a logically low state. It is important to realize that, since the partial duty cycle signals, CA and CB, are both 50% duty cycle signals, they appear to resemble inverted forms of each other. To avoid any misunderstanding relating to the operation of the present invention, it should be further understood that, although output signal OS1 appears to be identical to partial duty cycle signal CA, it is actually functionally dependent on partial duty cycle signal CB and, in addition, signal OS1 is an inverted form of partial duty cycle signal CB. Similarly, signal OS2 is an inverted form of partial duty cycle signal CA and signal OS3 is an inverted form of partial duty cycle signal CB. Therefore, in the terminology to be used below, signals OS1 and OS3 are functionally dependent on partial duty cycle signal CB and signal OS2 is functionally dependent on partial duty cycle signal CA, between time T0 and time T1, even though OS1 and OS3 appear to be identical to partial duty cycle signal CA and signal OS2 appears to be physically identical to partial duty cycle signal CB.

At time T1, input signal SI6 changes state from a logically low state to a logically high state. The result of this change is that output signal OS6 begins to be functionally dependent on partial duty cycle signal CA at time T1. It should be noted that this change, in power switching element 6, does not affect the output signals OS1, OS2 and OS3 of power switching elements 1, 2 or 3. Similarly, at time T2, signal SI8 changes from a logically low state to logically high state. Although this change causes signal OS8 to begin to be functionally dependent on partial duty cycle signal CB, the other preceding processing elements are unaffected. However, at time T3, when signal SI1 changes from a logically high state to a logically low state, several changes throughout the system can be seen. First, beginning at time T3, signal OS1 stops being dependent on partial duty cycle signal CB and begins to maintain a continuously low logical state. Because of the fact that the carry-out signal on line 26A is connected in single communication with the carry-in signal on line 24B, in FIG. 4, the second power switching element is affected as shown in the timing diagram of FIG. 5. At time T3, signal OS2 ceases to be functionally dependent on partial duty cycle signal CA and, instead, becomes functionally dependent on partial duty cycle signal CB as soon as signal SI1 of the first power switching element achieves a logically low state. Similarly, beginning at time T3, signals OS2, OS3, OS6 and OS8 all change their partial duty cycle dependency signal from signal CA to signal CB, or vice versa, depending on the dependency prior to the occurrence at time T3.

At time T4, signal SI4 changes from a logically low to a logically high state. It can be seen from FIG. 5 that this change does not affect the output signals of the preceding power switching elements. However, it can also be seen that this change in input signal SI4 affects not only its related output signal OS4, but also the output signal from the sixth power switching element. At time T4, signal OS6 changes from being dependent on partial duty cycle signal CB and begins to be dependent functionally on partial duty cycle signal CA. Fourteen such changes in the logical states of the input signals SI1–SI8, are shown in FIG. 5. Each change in the logical state of the input signals affects the directly related output signal and all output signals which are emanating from subsequent power switching elements. The relationships between the output signals in FIG. 5 illustrate the basic advantage of the present invention. This advantage is that each active output signal is maintained in an opposite logical state relative to the adjacent active power switching element outputs. For example, with reference to the time period between time T6 and time T7, it can be seen that the outputs OS3, OS4, OS5 and OS6 alternate in the partial duty cycle signals on which they are functionally dependent. This same characteristic can be seen by comparing the active output signals at any time period in the chronology of FIG. 5.

The above description, in relation to FIG. 5, illustrates the primary advantage of the present invention. This advantage relates to the fact that the output signals from the device shown in FIG. 4 are always generally equally divided between the two possible partial duty cycle signals provided on lines 21 and 22. If an even number of the inputs 14A–14H are in a logically high state, the outputs of the apparatus shown in FIG. 4 will be equally divided between the two possible partial duty cycle signals CA and CB. If an odd number of the inputs 14A–14H are logically high, the outputs of the apparatus in FIG. 4 will be divided as equally as possible between the two partial duty cycle signal inputs with one partial duty cycle signal being utilized by one more power switching element than the other partial duty cycle signal. Therefore, it should be apparent that the present invention distributes the two possible partial duty cycle signals as equally as possible under all circumstances regardless of which specific inputs are logically high or logically low. It should also be apparent from FIG. 4, that the power switching apparatus can be combined with other similarly configured power switching apparatus to equally distribute output signals for any number of input signals, depending on the number of power switching apparatus utilized. In other words, the apparatus shown in FIG. 4 can be provided as a module with the partial duty cycle signal lines 21 and 22 being connected to the partial duty cycle signal lines of other modules. Similarly, carry-out signal line 26H, shown in FIG. 4, can be connected in signal communication with a carry-in signal line of an additional module constructed similarly to that shown in FIG. 4.

Figure 6:
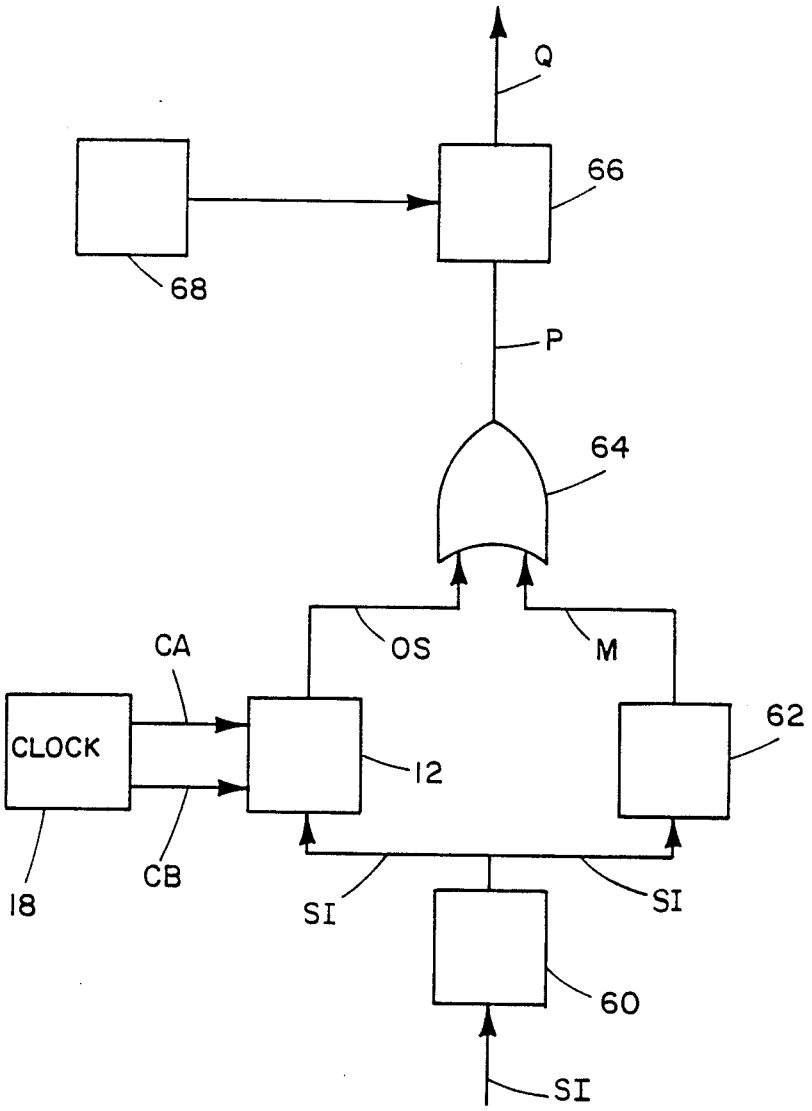
FIG. 6 illustrates a simplified schematic of a power switching element of the present invention in association with a monostable multivibrator.

FIG. 6 illustrates a preferred embodiment of the present invention in which the power switching elements described previously are used in conjunction with a monostable multivibrator. It should be understood that most solenoids or relays require an initial power level sufficient to cause the relay or solenoid to activate and, subsequent to initial activation, require a lesser power level signal to maintain the state of the relay or solenoid. Although the partial duty cycle signals described above are sufficient to maintain the activation of the solenoid or relay connected to the output of the power switching elements, the partial duty cycle signal may not be sufficient to cause the relay or solenoid to be initially activated. For this reason, a most preferred embodiment of the present invention incorporates a means, such as a monostable multivibrator, to provide a temporary full power signal for a preselected period of time upon the initiation of the input signal. This concept is illustrated schematically in FIG. 6. The input signal SI is received by an input port 60 and transmitted, in parallel, to a power switching element 12 and a means for providing the temporary full power signal, such as the monostable multivibrator 62. It should be understood that although a monostable multivibrator 62 is described as being used in the preferred embodiment of the present invention, alternative components can be used to perform this function in other embodiments of the present invention. The power switching element 12 operates, as described above in conjunction with FIG. 2, by receiving the two partial duty cycle signals, CA and CB, from a clock 18 and providing an output signal OS. The monostable multivibrator 62 receives the input signal SI and provides an output signal M which remains high for a predetermined period of time before returning to a logically low state. An OR device 64 is provided as shown in FIG. 6. The OR device 64 has two inputs and one output. The two inputs are connected to the output signal OS and the signal M from the monostable multivibrator 62. The output signal of the OR device 64 is provided to an output device 66 which can be a solenoid or relay. The output device 66 is provided with power from a power supply 68 and, upon activation of the output device 66 by signal P, an output Q is achieved. The purpose of the monostable multivibrator 62 is to provide a logically high signal for a predetermined period of time after which signal M is returned to a logically low state. When signal M returns to a logically low state, the output signal P from the OR device 64 is identical to the output signal OS from the power switching element 12.

Figure 7:
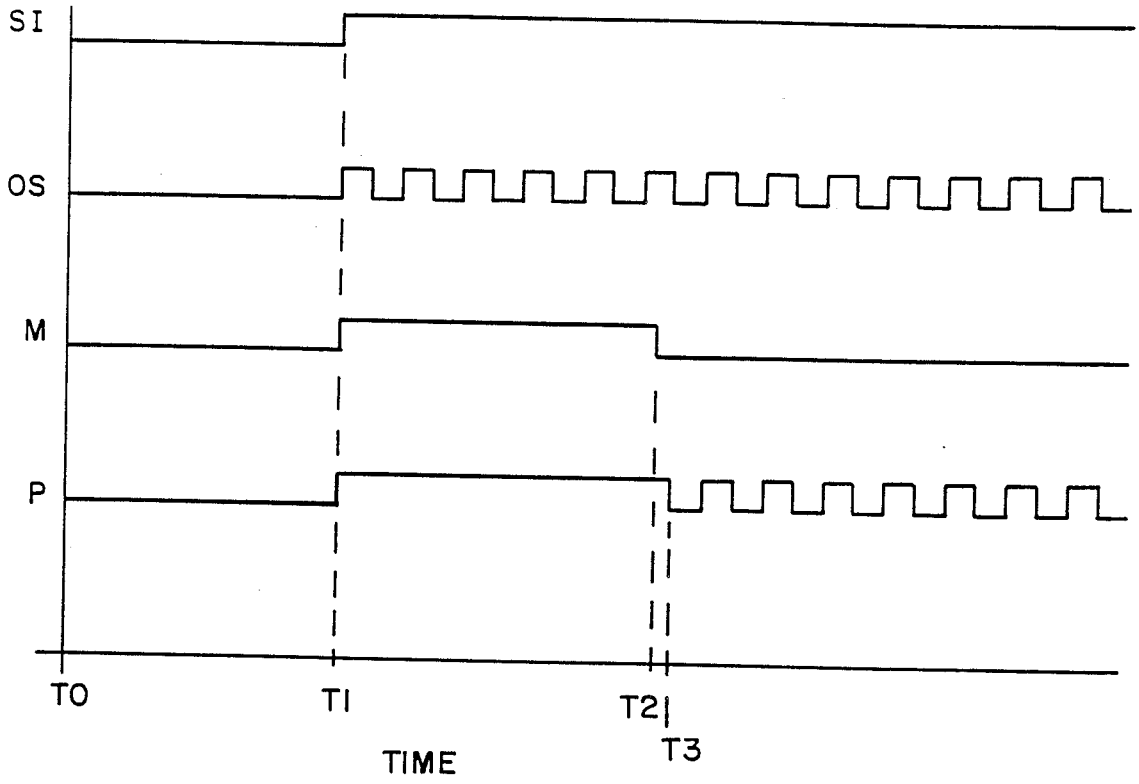
FIG. 7 is a timing diagram relating to the illustration of FIG. 6.

FIG. 7 is a timing diagram which illustrates the operation of the schematic circuit shown in FIG. 6. From time T0 to time T1, the input signal SI is in a logically low state. This results in the output signal OS also being at a logically low state. Because of the operation of the OR device 64, signal P is also at a logically low state and, because of the operation of the monostable multivibrator 62, signal M is also at a logically low state. Beginning at time T1, the input signal SI changes from a logically low state to a logically high state. This causes the output signal OS of the power switching element 12 to achieve an output signal which is functionally dependent on one of the two partial duty cycle signals, CA or CB. Simultaneously, at time T1, output M from the monostable multivibrator 62 changes from a logically low state to a logically high state and causes the output of the OR device 64 to change from a logically low state to a logically high state. Depending on the specific monostable multivibrator 62 which is used, the output signal M will remain high for a predetermined period of time. In FIG. 7, this predetermined period of time is illustrated as the time period between time T1 and time T2. At time T2, output signal M changes from a logically high state to a logically low state and, as a result, output signal P from the OR device 64 changes from a continuously high logical state to a an output wave form equivalent to the output signal OS of the power switching element 12. By using a configuration similar to that shown schematically in FIG. 6, an output signal can be provided which, upon initial receipt of a logically high input signal SI, provides a logically high signal P for a predetermined period of time followed by an output wave form P which is functionally dependent on one of the two partial duty cycle signals, CA or CB.

Throughout the description of the preferred embodiment of the present invention, the logical states of various signals have been described as being logically low or logically high. However, it should be clearly understood that alternative implementations of the present invention could operate within the scope of the present invention without being restricted to these specific logical states. For example, the use of inverters could easily change the logical state of any of the signals. Therefore, while the present invention has been described in terms of logically low states and logically high states, these logical states could alternatively be described as logically set states and logically reset states or the first logical states and second logical states. In addition, while the present invention incorporates specific logical devices, as illustrated in FIG. 2, alternative logical devices could be used to perform similar functions in alternative embodiments of the present invention.

It should be apparent from the above discussion that the present invention provides a means by which a plurality of power switching elements can be combined to form a power switching apparatus with a plurality of inputs and a plurality of associated outputs as described above. In addition, the present invention provides a means by which the outputs can be distributed in such a way that a generally equal number of outputs are assigned to have a first wave form and a generally equal number of outputs are assigned to have a different wave form. The present invention also comprises a means by which a continuous signal is provided for a predetermined period of time following the initial receipt of an input signal after which the partial duty cycle signal is provided until the input signal is deactivated. It should be understood that, although the present invention has been described in significant detail and illustrated with a high degree of specificity, alternative embodiments of the present invention should be considered within its scope.

What I claim is:

1. A power switching apparatus, comprising:

a first power switching element, said first power switching element comprising a first means for receiving a first input signal and a first means for providing logically selected one of first and second types of output signals in response to a logically set first input signal, said first receiving means being connected in signal communication with said first providing means;

a second power switching element, said second power switching element comprising a second means for receiving a second input signal and a second means for providing a logically selected one of said first and said second types of output signals in response to a logically set second input signal; and means for causing said second power switching element to provide said second type of output signal when said first power switching element provides said first type of output signal and means for causing said second power switching element to provide said first type of output signal when said first power switching element provides said second type of output signal, said causing means being connected in signal communication with said first and second power switching elements.

2. The apparatus of claim 1, wherein:

said causing means comprises first means for providing a first carry-out signal from said first power switching element, said first carry-out signal being representative of said logically selected one of said first and second types of output signals provided by said first power switching elements, said first carry-out signal providing means being connected in signal communications with a second means for receiving a carry-in signal of said second power switching element, said second carry-in signal receiving means of said second power switching element being connected in signal communication with said second input signal receiving means of said second power switching element.

3. The apparatus of claim 1, wherein:

said first power switching element comprises an exclusive-OR device having said first input signal receiving means connected in signal communication with one input of said exclusive-OR device and a first means for receiving an externally provided carry-in signal connected in signal communication with another input of said exclusive-OR device.

4. A power switching apparatus, comprising:

a first power switching element and a second power switching element;

said first power switching element comprising a first means for providing a first output signal, a first means for receiving a first input signal, a first means for receiving a first carry-in signal, a first means for providing a first carry-out signal, a first means for receiving a first partial duty cycle signal, a first means for receiving a second partial duty cycle signal and a first means for connecting a logically selected one of said first and second partial duty cycle signal receiving means in signal communication with said first output signal providing means in response to a preselected combination of logical states of said first carry-in signal and said first input signal, said first carry-out signal being representative of the combined logical states of said first carry-in signal and said first input signal said first output signal providing means being connected in signal communication with said first input signal receiving means, said first means for receiving said first and second partial duty cycle signals being connected in signal communication with said first output signal providing means;

said second power switching element comprising a second means for providing a second output signal, a second means for receiving a second input signal, a second means for receiving a second carry-in signal, a second means for providing a second carry-out signal, a second means for receiving said first partial duty cycle signal, a second means for receiving said second partial duty cycle signal and second means for connecting a logically selected one of said first and second partial duty cycle signal receiving means in signal communication with said second output signal providing means in response to a preselected combination of logical states of said second carry-in signal and said second input signal, said second carry -out signal being representative of the combined logical states of said second carry-in signal, said second output signal providing means being connected in signal communication with said second input signal receiving means, said second means for receiving said first and second partial duty cycle signals being connected in signal communication with said second output signal providing means said second input signal; and said first carry-out signal providing means being connected in signal communication with said second carry-in signal providing means.

5. The apparatus of claim 4, wherein:

said first partial duty cycle signal is a square wave and said second partial duty cycle signal is a square wave.

6. The apparatus of claim 4, wherein:

said first partial duty cycle is generally a 50% duty cycle and said second partial duty cycle is generally a 50% duty cycle.

7. The apparatus of claim 4, wherein:

said first carry-out signal providing means comprises an exclusive-OR device having first and second inputs and a first output, said first input of said exclusive-OR device being connected in signal communication with said first carry-in signal receiving means, said second input of said exclusive-OR device being connected in signal communication with said first input signal receiving means and said output of said exclusive-OR device being connected in signal communication with said carry-out signal providing means.

8. A power switching apparatus, comprising:

a first power switching element which comprises;

first means for receiving a first input signal;

first means for receiving a first partial duty cycle signal;

first means for receiving a second partial duty cycle signal;

first means for receiving a first carry-in signal;

first means for providing a first output signal in response to a receipt of said first input signal, said first output signal being functionally related to said first partial duty cycle signal when said first carry-in signal is logically reset, said first output signal being functionally related to said second partial duty cycle signal when said first carry-in signal is logically set, said first output signal providing means being connected in signal communication with said first carry-in signal receiving means and said first means for receiving said first and second partial duty cycle signals; and first means for providing a first carry-out signal, said first carry-out signal having the same logical state as the first carry-in signal when said first input signal is reset, said first carry-out signal having an opposite logical state than said first carry-in signal when said first input signal is set, said first carry-out signal providing means being connected in signal communication with said first carry-in signal receiving means and said first input signal receiving means.

9. The apparatus of claim 8, further comprising:

a second power switching element which comprises;

second means for receiving a second input signal;

second means for receiving said first partial duty cycle signal;

second means for receiving said second partial duty cycle signal;

second means for receiving a second carry-in signal;

second means for receiving a second input signal;

second means for providing a second output signal in response to a receipt of said second input signal, said second output signal being functionally related to said first partial duty cycle signal when said second carry-in signal is logically reset, said second output signal being functionally related to said second partial duty cycle signal when said second carry-in signal is logically high, said second output signal providing means being connected in signal communication with said second carry-in signal receiving means and said second means for receiving said first and second partial duty cycle signals;

second means for providing a second carry-out signal, said second carry-out signal having the same logical state as said second carry-in signal when said second input signal is reset, said second carry-out signal having an opposite logical state than said second carry-in signal when said input signal is set, said second carry-out signal providing means being connected in signal communication with said second carry-in signal receiving means and said second input signal receiving means;

said second carry-in signal of said second power switching element being connected in signal communication with said first carry-out signal of said first power switching element.

10. The apparatus of claim 8, wherein:

said first partial duty cycle signal is a square wave and said second partial duty cycle signal is a square wave.

11. The apparatus of claim 8, further comprising:

means for causing said first output signal to be logically set for a preselected length of time following a change in the logical state of said first input signal said preselected length of time being independent from said first and second partial duty cycle signals.

12. A power switching apparatus having a first power switching element, comprising:

an exclusive-OR device having a first input connected in signal communication with an externally provided first carry-in signal and a second input connected in signal communication with a first input signal, said exclusive-OR device having an output connected in signal communication with a first carry-out signal;

a first NAND device having a first input connected in signal communication with an inverted form of said first carry-out signal and a second input connected in signal communication with a first partial duty cycle signal, said first NAND device having an output connected in signal communication with a first input of a first AND device; and a second NAND device having a first input connected in signal communication with said first carry-out signal and a second input connected in signal communication with a second partial duty cycle signal, said second NAND device having an output connected in signal communication with a second input of said first AND device, said first AND device having a third input connected in signal communication with said first input signal, whereby an output of said first AND device is functionally related to said first partial duty cycle signal in response to receipt of said first input when said first carry-in signal is logically reset and whereby said output of said first AND device is functionally related to said second partial duty cycle signal in response to receipt of said first input when said first carry-in signal is logically set.

13. The apparatus of claim 12, further comprising:

a second power switching element constructed similarly to said first power switching element;

said first input of said exclusive-OR device of said second power switching element being connected in signal communication with said output of said exclusive-OR device of said first power switching element.

14. The apparatus of claim 12, further comprising:

a first OR device having a first input connected in signal communication with said output of said AND device; and means connected in signal communication with said first input signal for providing a logically set signal of preselected duration in response to a change in said first input signal form a logically reset state to a logically set state, said providing means having an output connected in signal communication with a second input of said first OR device.

15. The apparatus of claim 14, wherein:

an output of said first OR device is connected in signal communication with a relay.

16. The apparatus of claim 14, wherein:

an output of said first OR device is connected in signal communication with a solenoid.

17. A power switching apparatus, comprising:

a plurality of power switching elements, each of said plurality of power switching elements comprising a means for receiving an input signal, a means for providing an output signal, a means for receiving a carry-in signal and a means for providing a carry-out signal, each of said plurality of power switching elements having its associated carry-in signal receiving means connected in signal communication with a carry-out signal providing means of a preselected other one of said plurality of power switching elements, each of said plurality of power switching elements comprising a means for connecting a logically selected one of first and second partial duty cycle signals in signal communication with said output signal providing means in response to receipt of said input signal by said input signal receiving means, said logically selected one of said first and second partial duty cycle signals being selected to differ from said output signal of adjacent ones of said plurality of power switching elements having logically high input signals.

18. A power switching apparatus, comprising means for providing a plurality of output signals;

means for receiving a plurality of input signals, each of said plurality of output signals being associated with a logically selected one of said plurality of input signals;

means for causing each of said plurality of said output signals to take the form of one of two partial duty cycle signals in response to receipt of said associated input signal; and means for assuring that the number of output signals taking the form of a first one of said two partial duty cycle signals is within one count of the number of output signals taking the form of a second one of said two partial duty cycle signals.

19. The power switching apparatus of claim 18, further comprising:

means for providing a carry-out signal associated with each of said plurality of output signals, said carry-out signal being representative of said form of said associated output signal, said carry-out signal being connected in signal communication with one of said input signals associated with another one of said output signals.

* * * * *